US008564519B2

(12) United States Patent
Yamashita et al.

(10) Patent No.: US 8,564,519 B2
(45) Date of Patent: Oct. 22, 2013

(54) OPERATING METHOD AND DISPLAY PANEL USING THE SAME

(75) Inventors: Keitaro Yamashita, Hyogo (JP); Masahiro Yoshiga, Hyogo (JP); Satoru Takahashi, Hyogo (JP)

(73) Assignee: Chimei Innolux Corporation (TW)

( * ) Notice: Subject to any disclaimer, the term of this patent is extended or adjusted under 35 U.S.C. 154(b) by 13 days.

(21) Appl. No.: 13/207,111

(22) Filed: Aug. 10, 2011

(65) Prior Publication Data

US 2013/0038595 A1 Feb. 14, 2013

(51) Int. Cl.
*G09G 3/36* (2006.01)

(52) U.S. Cl.
USPC ..... 345/90; 345/98

(58) Field of Classification Search
USPC ..... 345/87–102, 690, 209, 210
See application file for complete search history.

(56) References Cited

U.S. PATENT DOCUMENTS

2007/0040785 A1* 2/2007 Edwards et al. ..... 345/92
2009/0040174 A1 2/2009 Yamashita
2009/0128473 A1 5/2009 Yamashita et al.
2009/0284500 A1 11/2009 Yamashita
2010/0001970 A1 1/2010 Yamashita
2010/0085286 A1 4/2010 Yamashita et al.

FOREIGN PATENT DOCUMENTS

WO WO03007286 1/2003
WO WO03009268 1/2003
WO WO2004090854 10/2004

OTHER PUBLICATIONS

Yamashita, K., et al., "Dynamic Self-Refreshing Memory-in-Pixel Circuit for Ultra Lowe Power 302ppi LTPD TFT-LCD", IDW 2010, pp. 257-258.

* cited by examiner

*Primary Examiner* — Duc Dinh
(74) *Attorney, Agent, or Firm* — Lowe Hauptman & Ham, LLP

(57) ABSTRACT

An operating method and a display panel are provided. The method Includes a number steps. A display panel is provided, and has a pixel element, the pixel element including an n-bit memory, n being a positive integer in accordance with image data. The pixel element is driven by using a k-th data voltage, k being smaller than $2^n$, the k-th data voltage ranging between a plurality of data voltages having absolute values in an increasing order. When k is odd, the k-th data voltage has one of positive and negative polarities. When k is even, the k-th data voltage has the other one of positive and negative polarities.

10 Claims, 13 Drawing Sheets

| Color | Voltage | \|dV\| |
|---|---|---|
| Green | 4.78 | |
| | | 0.64 |
| Cyan | 4.14 | |
| | | 0.28 |
| Blue | 3.86 | |
| | | 0.26 |
| Magenta | 3.6 | |
| | | 0.09 |
| Red | 3.51 | |
| | | 0.26 |
| Yellow | 3.25 | |
| | | 0.32 |
| White | 2.93 | |
| | | 2.43 |
| Black | 0.5 | |

| Color | Voltage | \|dV\| |
|---|---|---|
| Cyan | 4.14 | |
| | | 0.54 |
| Magenta | 3.6 | |
| | | 0.35 |
| Yellow | 3.25 | |
| | | 2.75 |
| Black | 0.5 | |
| | | 3.43 |
| White | -2.93 | |
| | | 0.58 |
| Red | -3.51 | |
| | | 0.35 |
| Blue | -3.86 | |
| | | 0.92 |
| Green | -4.78 | |

| Color | Voltage | \|dV\| |
|---|---|---|
| Green | 4.78 | |
| | | 0.92 |
| Blue | 3.86 | |
| | | 0.93 |
| White | 2.93 | |
| | | 2.43 |
| Black | 0.5 | |

| Color | Voltage | \|dV\| |
|---|---|---|
| Cyan | 4.14 | |
| | | 0.63 |
| Red | 3.51 | |
| | | 0.58 |
| White | 2.93 | |
| | | 2.43 |
| Black | 0.5 | |

FIG. 8A

| Color | Voltage | \|dV\| |
|---|---|---|
| Green | 4.78 | |
| | | 1.85 |
| White | 2.93 | |
| | | 3.43 |
| Black | -0.5 | |
| | | 3.36 |
| Blue | -3.86 | |

| Color | Voltage | \|dV\| |
|---|---|---|
| Cyan | 4.14 | |
| | | 1.21 |
| White | 2.93 | |
| | | 3.43 |
| Black | -0.5 | |
| | | 3.01 |
| Red | -3.51 | |

FIG. 9A

OPERATING METHOD AND DISPLAY PANEL USING THE SAME

BACKGROUND OF THE INVENTION

1. Field of the Invention

The invention relates in general to an operating method and a display panel using the same, and more particularly to an operating method for a multi-bit memory in pixel (MIP) and a display panel using the same.

2. Description of the Related Art

Display devices have been widespread used in a variety of applications, such as lap-top computers, mobile phones, or personal digital assistants. As to a display device, the number of bit, or bit depth is associated with the visual quality of displayed images. As is defined in computer graphics, color depth or bit depth is the number of bits used to represent the color or gray levels of a single pixel in a bitmapped image or video frame buffer. This concept is also known as bits per pixel (BPP), particularly when specified along with the number of bits used. Higher number of bits usually gives a broader range of distinct colors or gray levels.

As an additional feature of display devices, a memory in pixel (MIP), which is considered for reducing power consumption, has a pixel memory which can be used to maintain the gray level of the MIP without new data being provided from a source driver, so that power consumption can be reduced. In general, applying intermediate voltages to a pixel generates a number of gray levels in display. A multi-bit MIP, when being requested to generate a constant gray level, is refreshed by detecting its pixel voltage, which determines which gray level the pixel has, or more generally identifies what kind of image data the pixel is previously stored. At this time, the threshold voltage of switches used in the multi-bit MIP is served as a basic voltage interval at which these intermediate voltages are spaced. If the stored image data can be correctly identified, the multi-bit MIP can be correctly refreshed thereafter.

However, there is a problem with refresh operation of the multi-bit MIP. In the multi-bit MIP, the number of bits is increased by reducing the voltage difference corresponding to two adjacent grey levels, so that more intermediate voltages can be assigned to describe more grey levels, thereby providing an increased number of bits. Due to the manufactured process of the display devices, the threshold voltage variation is diverse with respect to difference display devices. As such, when the voltage difference corresponding to two adjacent grey levels becomes too small, there is a problem with refresh operation that it is critical, sometimes impossible to identify what kind of image data the pixel is stored with. Therefore, the reliability of refresh operation is reduced, resulting in a limited number of bits per pixel.

SUMMARY OF THE INVENTION

The invention is directed to an operating method and a display panel using the same, in which the reliability of refresh operation can be increased.

According to an aspect of the present invention, an operating method is provided. The method includes a number of steps. A display panel is provided, and has a pixel element, the pixel element including an n-bit memory, n being a positive integer in accordance with image data. The pixel element is driven by using a k-th data voltage, k being equal to or smaller than $2^n$, the k-th data voltage ranging between a plurality of data voltages having absolute values in an increasing order. When k is odd, the k-th data voltage has one of positive and negative polarities. When k is even, the k-th data voltage has the other one of positive and negative polarities.

According to another aspect of the present invention, an operating method for use in image data refreshing is provided. The method includes a number of steps. In a first period, a data signal having a first data voltage is provided to selectively refresh the image data of an image data storage capacitor of a pixel element. In a second period, the data signal having a second data voltage is provided to selectively refresh the image data of the image data storage capacitor. The polarity of the second data voltage being opposite to the polarity of the first data voltage. When the image data is of a first image data, the image data of the image data storage capacitor is refreshed during the first period. When the image data is of a second image data which is numerically adjacent with the first image data, the image data of the image data storage capacitor is refreshed during the second period.

According to another aspect of the present invention, a display panel is provided. The display panel includes an active matrix pixel array, a source drive, and a gate driver. The active matrix pixel array includes a number of gate lines, a number of source lines, a number of pixel elements. The source driver drives the source lines. The gate driver drives the gate lines. The pixel elements are arranged in a matrix. Each pixel element is coupled to the corresponding gate line and the corresponding source line. Each pixel element includes an n-bit memory, n being in accordance with image data. The source driver drives the pixel element by using a k-th data voltage, k being equal to or smaller than $2^n$, the k-th data voltage ranging between a plurality of data voltages having absolute values in an increasing order, wherein when k is odd, the k-th data voltage has one of positive and negative the polarities, and when k is even, the k-th data voltage has the other one of positive and negative polarities.

The above and other aspects of the invention will become better understood with regard to the following detailed description of the preferred but non-limiting embodiment(s). The following description is made with reference to the accompanying drawings.

BRIEF DESCRIPTION OF THE DRAWINGS

FIG. 8A is a table showing an example of the relationship between colors and applied voltages of two pixels where the applied voltages have a same polarity.

FIG. 9A is a table showing an example of the relationship between colors and applied voltages of two pixels according to an embodiment of the invention.

DETAILED DESCRIPTION OF THE INVENTION

An operating method and a display panel using the same are provided in a number of exemplary embodiments as follows. In an embodiment, in order for the data voltages used to generate gray levels or colors to be spaced at proper intervals, opposite voltage polarities are used such that the voltage difference corresponding to two adjacent gray levels or colors is increased. In this way, the refresh operation of pixels can be performed in higher reliability. Further description is provided as follows with reference to accompanying drawings.

Figure 1:
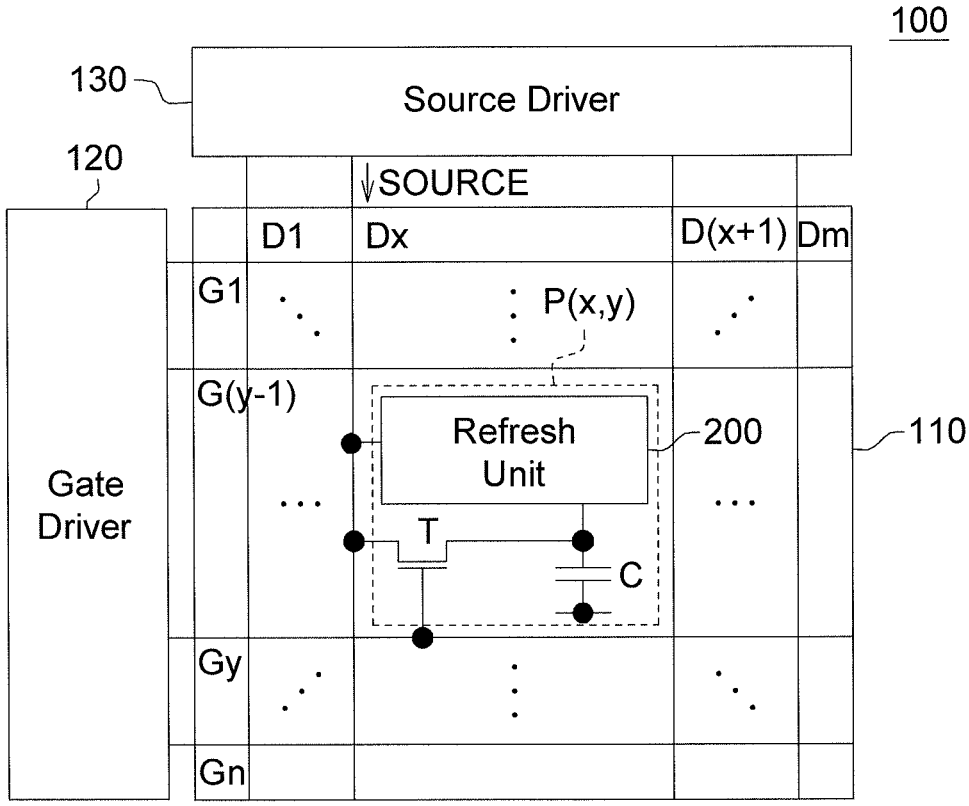
FIG. 1 is a block diagram showing an example of a display panel according to an embodiment of the invention.

FIG. 1 is a block diagram showing an example of a display panel according to an embodiment of the invention. The display panel 100 at least includes an active matrix pixel array 110, a gate driver 120, and a source driver 130. The active matrix pixel array 110 includes a number of gate lines G1-Gn and a number of source lines D1-Dm. The gate driver 120 drives the scan lines G1-Gn. The source driver 130 drives the source lines D1-Dm.

The active matrix pixel array 110 further includes a number of pixel elements arranged in a matrix, each being coupled to the corresponding gate line and the corresponding source line. As is made as an example, a pixel element P(x,y) includes an image data storage capacitor C, a gate switch T, and a refresh unit 200 according to an embodiment of the invention. The gate switch T has a control terminal coupled to the corresponding gate line Gy, and two data terminals coupled between the corresponding source line Dx and the image data storage capacitor C. The refresh unit 200 is coupled between the corresponding source line Dx and the image data storage capacitor C. The refresh unit 200 refreshes the image data stored in the image data storage capacitor C.

The display panel 100 can be operated at two modes, one of which is, for example, an active mode such as the video mode of the display device, while the other is, for example, a passive or refresh mode such as a standby mode of an electronic device including the display panel 100. When being operated at the active mode, the display panel 100 stores or writes image data in the pixel element P(x,y). When being operated at the refresh mode, the display panel 100 allows the pixel element P(x,y) to refresh its image data, i.e., to maintain the image data which is previously stored in the pixel element P(x,y), thus generating a constant output such as static image over a prolonged period of time.

In FIG. 1, the pixel element P(x,y) of the display panel 100 includes an n-bit memory, i.e., the image data storage capacitor C, where n is in accordance with image data, thus becoming a multi-bit memory in pixel (MIP) with which a numbers of gray levels or colors can be generated. Since the gray level of a pixel is determined by the voltage level of a data signal SOURCE provided form the source driver 130, different data voltages can be carried on the data signal SOURCE to make the pixel element P(x,y) generate different gray levels. In a number of examples made as follows, the data voltages of the data signal SOURCE are referred to as grayscale voltages which are provided to the pixel element P(x,y) to generate a number of corresponding gray levels.

Figure 2A:
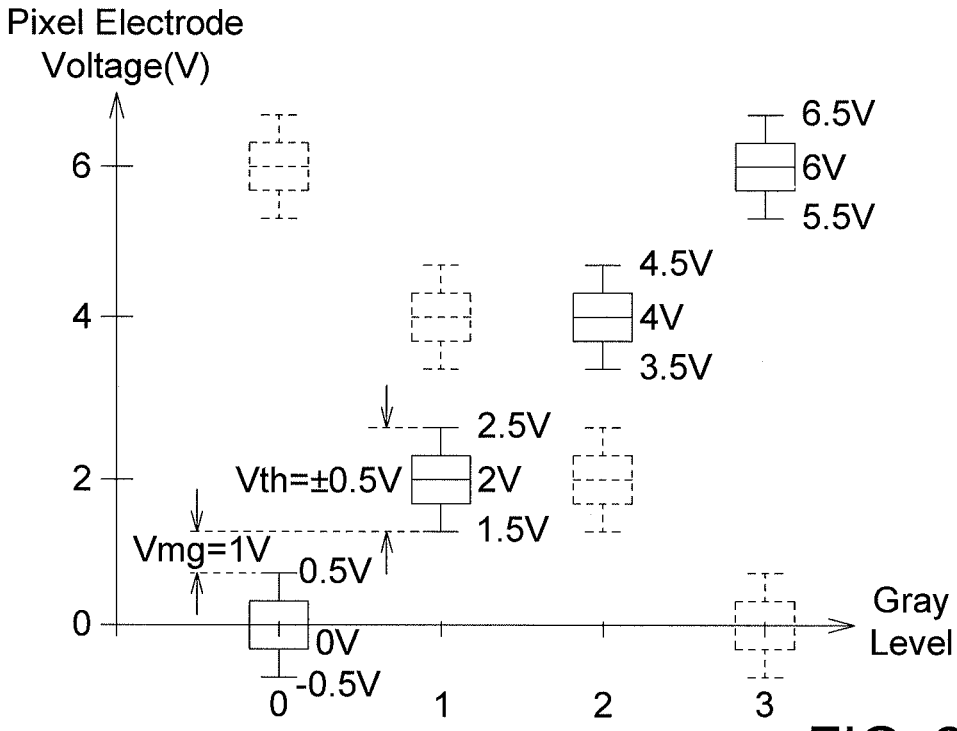
FIGS. 2A and 2B are box-plot diagrams each of which is an example showing the relationship between gray levels and grayscale voltages for use in a 2-bit MIP.
Figure 2B:
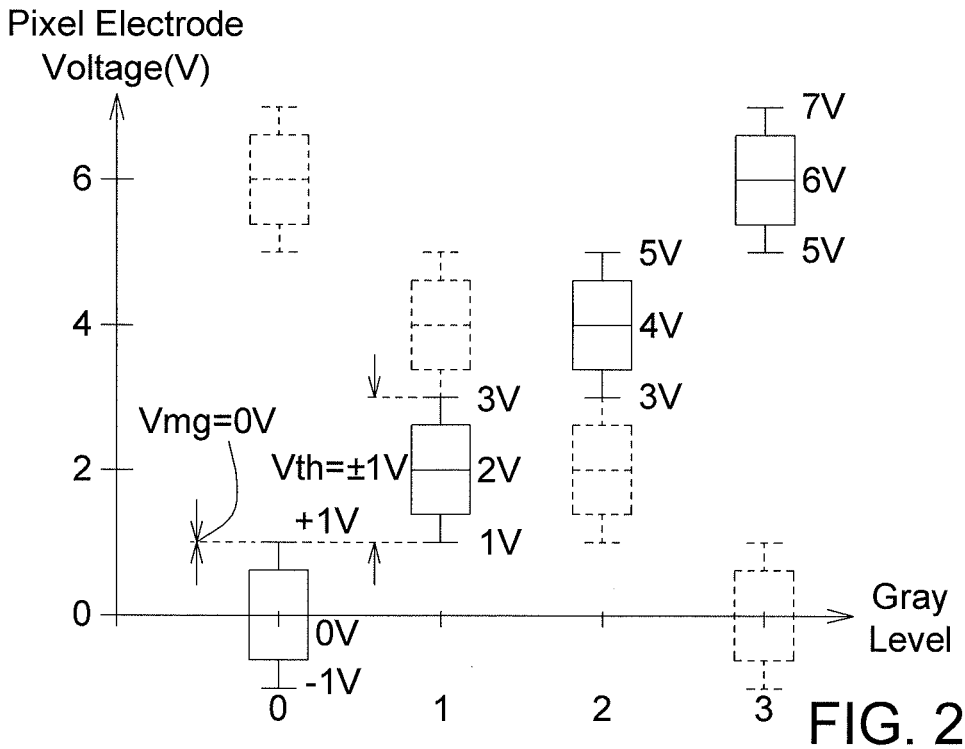

FIGS. 2A and 2B are box-plot diagrams each of which is an example showing the relationship between gray levels and grayscale voltages for use in a 2-bit MIP. Refer to FIG. 2A, where the 2-bit MIP is applied there across one of four grayscale voltages such as 0V, 2V, 4V, and 6V, in an attempt to store therein one of four kinds of image data such as binary codes of 00, 01, 10, and 11 whose numerical values are indicative of four gray levels 0, 1, 2, and 3. In a case where a normally black display panel is used, the grayscale voltages of 0V, 2V, 4V, and 6V are assigned to describe the corresponding gray levels of 0, 1, 2, and 3, respectively. On the other hand, in another case, the grayscale voltages of 6V, 4V, 2V, and 0V can also be assigned to describe the corresponding gray levels of 0, 1, 2, and 3, respectively, as shown in dashed marks. As to two image data such as image data of 00 and 01 which are numerically adjacent with each other, they are indicative of two adjacent gray levels such as gray levels of 0 and 1, and the corresponding grayscale voltages such as 0V and 2V are spaced at an interval defined by a voltage difference. As can be seen from FIG. 2A, the voltage difference corresponding to two adjacent gray levels is 2V. Because of a threshold voltage variation Vth which is exemplified as being within a range of ±0.5V in FIG. 2A, the detected pixel electrode voltages will vary within a range of 1V as denoted in each box. Therefore, in the example of FIG. 2A, the voltage margin Vmg among these gray levels is about 1V.

Since the threshold voltage variation is diverse with respect to difference display panels, it is exemplified that there is a wider threshold voltage variation Vth within a range of ±1V in FIG. 2B. At this time, among these gray levels, the voltage margin Vmg is reduced to 0V. The voltage margin Vmg of 0V means that the identification of each gray level becomes critical. For example, when a pixel electrode voltage of 1V is detected, there is a dilemma, or a situation in which it is difficult to decide that which one of the grayscale voltages of 0V and 2V the detected pixel electrode voltage belongs to, or which one of the grey levels of 0 and 1 the pixel has. As a result, it is possible that the refresh operation fails in correctly identifying the gray level of the 2-bit MIP, and the 2-bit MIP may be refreshed as having a different, wrong gray level. Such a situation becomes even worse when the threshold voltage variation is higher than ±1V.

From the aforementioned description of FIGS. 2A and 2B, the applicants found that the reason of the unreliable refresh operation and the limited number of bits is related to the voltage difference corresponding to two adjacent gray levels. In FIGS. 2A and 2B, the 2-bit MIP is implemented by using a number of voltages such as 0V, 2V, 4V, and 6V which all have a same, single polarity except for 0V, resulting in a reduced voltage difference corresponding to two adjacent gray levels. In response thereto, the applicants makes an attempt to increase the voltage difference corresponding to two adjacent gray levels, and provides a number of exemplary embodiments by making use of a characteristic of the liquid crystal that the transmittance response of the liquid crystal is regardless of the polarity of the applied field or voltage. More specifically, there is an embodiment where both positive and negative voltages are assigned to describe gray levels.

In an exemplary embodiment, in addition to the voltages having a single polarity such as a positive polarity, another set of voltages having an opposite, inversed polarity such as a negative polarity is introduced to generate grey levels. Furthermore, as to two voltages which are used to generate adjacent grey levels, they are assigned to have opposite polarities. In this way, the voltage difference corresponding to two gray levels can be increased. An example is made with reference to FIG. 3 for further illustration.

Figure 3:
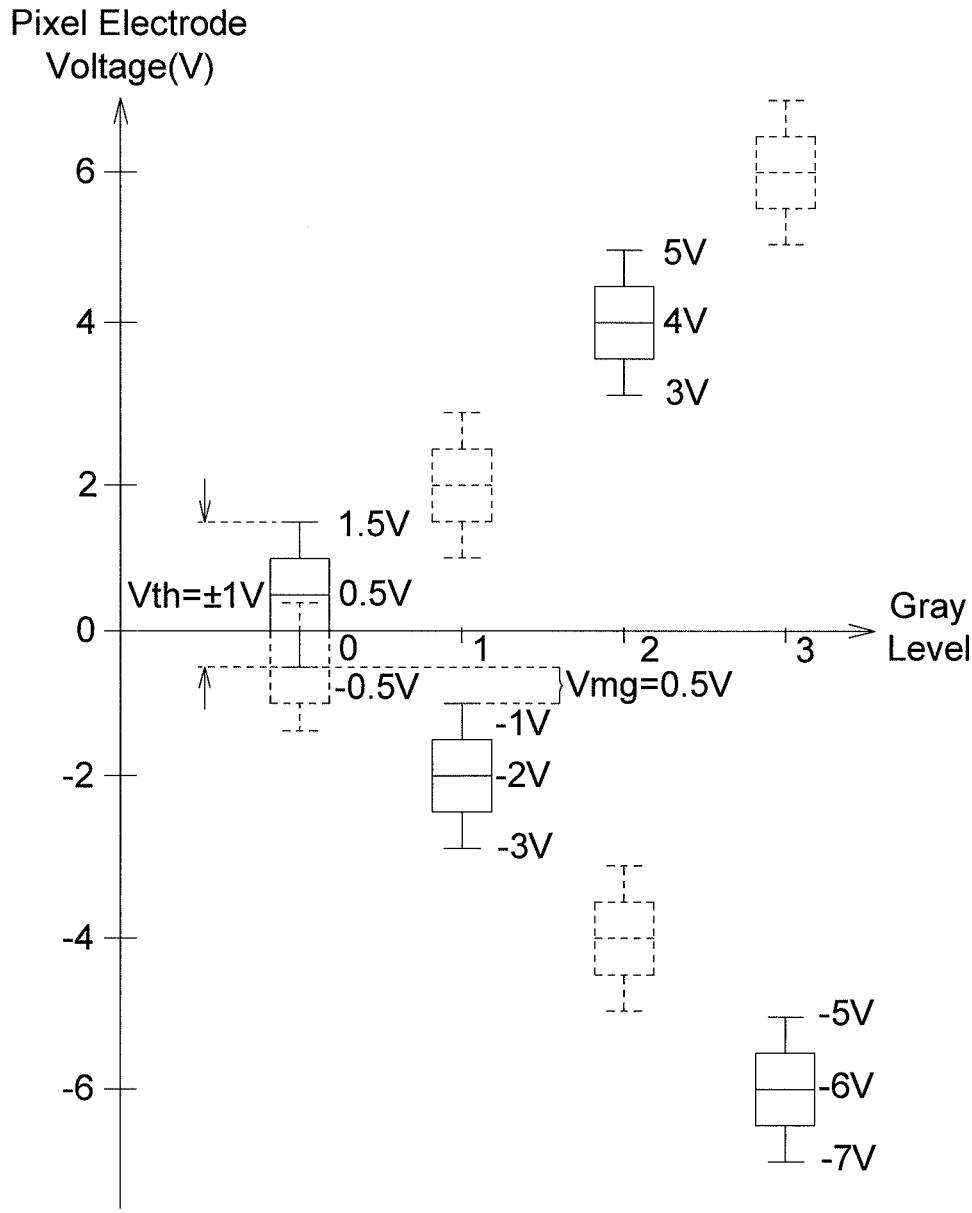
FIG. 3 is a box-plot diagram showing an example of the relationship between gray levels and grayscale voltages for use in a 2-bit MIP according to an embodiment of this invention.

FIG. 3 is a box-plot diagram showing an example of the relationship between gray levels and grayscale voltages for use in a 2-bit MIP according to an embodiment of this invention. As compared with the grayscale voltages of 0V, 2V, 4V, and 6V in FIG. 2B, the corresponding grayscale voltages of the four gray levels 0, 1, 2, and 3 are assigned to be +0.5V, −2V, +4V, and −6V, respectively, as shown in FIG. 3. Among these grayscale voltages of +0.5V, −2V, +4V, and −6V, the voltage difference corresponding to two adjacent gray levels is increased. For example, the voltage difference corresponding to gray levels of 0 and 1 is increased from 2V to 2.5V, the voltage difference corresponding to gray levels of 1 and 2 is increased from 2V to 6V, and the voltage difference corresponding to gray levels of 2 and 3 is increased from 2V to 10V.

Moreover, as to the image data of 00 which is indicative of a corresponding gray level of 0V, its grayscale voltage is exemplified in the example of FIG. 3 as being shifted from 0V to a predefined voltage such as +0.5V. The predefined voltage is determined such that the voltage difference corresponding to the gray levels of 0 and 1 can be increased, resulting in a higher voltage margin of 0.5V that makes possible distinguishing one gray level from another. In a practical example, the predefined voltage is for example but non-limitedly within a range of 1V and −1V. Besides, since the change of optical property of liquid crystal around 0V is negligibly small in case of a normally black display panel, the voltage shift of 0.5V from 0V would not bring significant effect to the display, and the optical property such as the luminance or reflectance of the display panel 100 can be substantially remained.

Refer to FIG. 3. It is assumed that the common voltage is 0V, which is a voltage along with the pixel voltage being applied across a pixel to generate a corresponding gray level. Under this assumption, there is another embodiment where the grayscale voltages in FIG. 3 are assigned to be −0.5V, +2V, −4V, and +6V, as shown in dashed marks. Thus, it can be seen from FIG. 3 that the voltage difference corresponding to two adjacent gray levels can also be increased. Moreover, the voltage margin Vmg is improved from 0V to 0.5V when the same threshold voltage variation Vth of ±1V as that in FIG. 2B is taken into consideration.

Figure 4A:
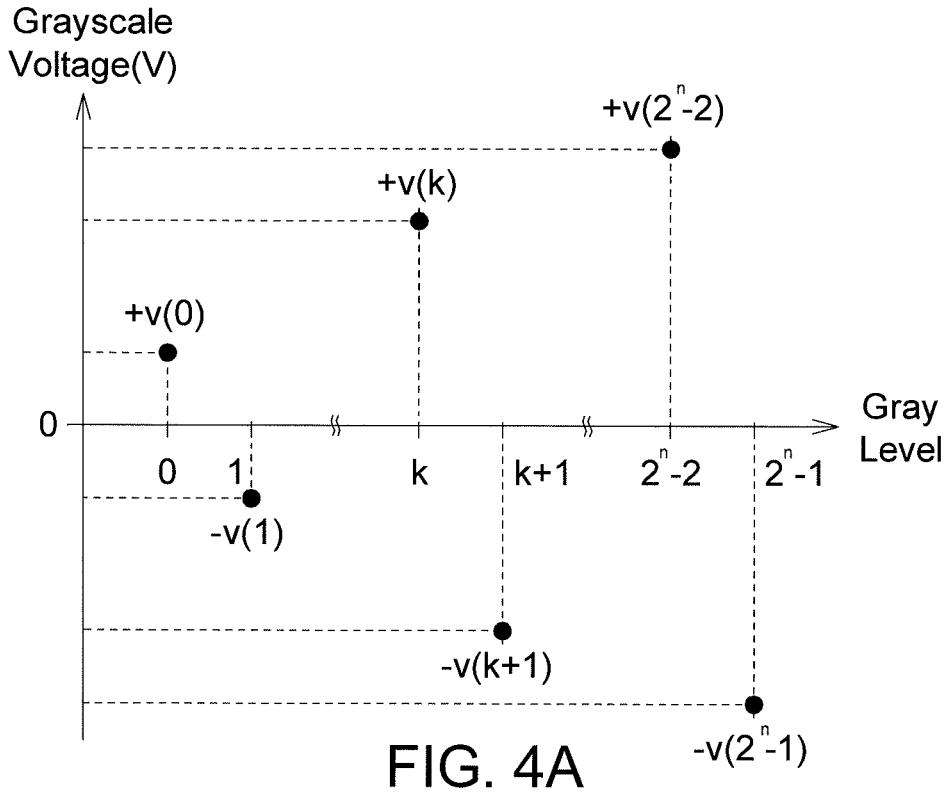
FIGS. 4A and 4B are schematic diagrams each showing an example of the relationship between gray levels and grayscale voltages for use in an n-bit MIP according to an embodiment of this invention.
Figure 4B:
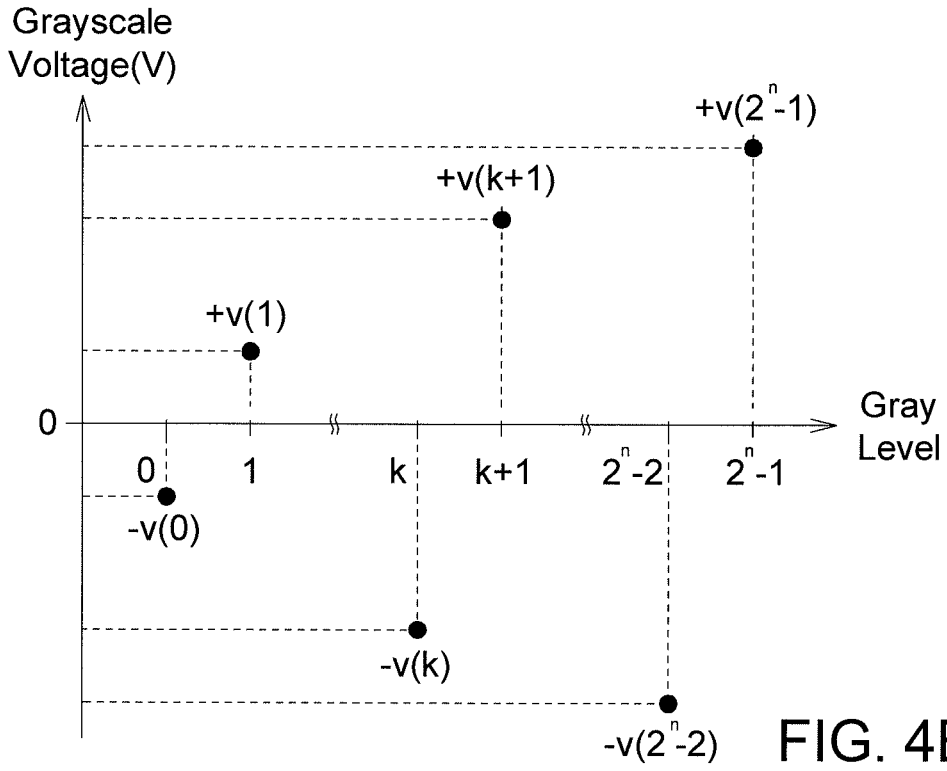

FIGS. 4A and 4B are schematic diagrams each showing an example of the relationship between gray levels and grayscale voltages for use in an n-bit MIP according to an embodiment of this invention. It is assumed that an n-bit MIP is used to generate $2^n$ gray levels. As to those grayscale voltages used to generate the $2^n$ gray levels, they are shown in FIG. 4A for positive phase, while shown in FIG. 4B for negative phase.

Among them, a k-th grayscale voltage is assigned to generate a k-th gray level, and can be derived from analysis of exemplary equations as follows:

$$V_{kp}=(-1)^k\cdot v(k) \quad (1)$$

$$V_{kn}=(-1)^{k+1}\cdot v(k) \quad (2)$$

where k is an integer between 0 and $2^n-1$, v(k) is the k-th grayscale voltage in magnitude, Vkp is the k-th grayscale voltage for positive phase, and Vkn is the k-th grayscale voltage for negative phase.

In equations (1) and (2), the grayscale voltages of v(0) to v(2n−1) are expressed in the form of their magnitudes, i.e., they are absolute values. The grayscale voltages of v(0) to v(2n−1) are in an increasing order, e.g., $v(0)<v(1)<\ldots v(2^n-2)<v(2^n-1)$. In a practical example, these grayscale voltages of v(0) to $v(2^n-1)$ can be spaced at equal intervals, which establishes the linear relationship between gray levels and grayscale voltages. In another practical example, based on a phenomenon that the transmittance or reflectance response of the liquid crystal to the applied voltage is nonlinear, the grayscale voltages of v(0) to $v(2^n-1)$ can also be spaced at unequal intervals. A person having ordinary skill in the art can acknowledge from the description of the equations (1) and (2) that these grayscale voltages of v(0) to $v(2^n-1)$ are adjustable, and can be used to meet different requirements.

At least based on the equations (1) and (2), as to a k-th gray level and a (k−1)th gray level, their corresponding grayscale voltages are assigned to have opposite polarities. From another aspect, when k is odd, the k-th grayscale voltage has one of positive and negative polarities, and when k is even, the k-th grayscale voltage has the other one of positive and negative polarities. For example, as can be seen from FIG. 4A, when k is odd, the k-th data voltage v(k) has negative polarity, and when k is even, the k-th data voltage has positive polarity. For another example, as can be seen from FIG. 4B, when k is odd, the k-th data voltage v(k) has positive polarity, and when k is even, the k-th data voltage has negative polarity. In this way, the voltage difference corresponding to two adjacent gray levels can be increased, and the refresh operation of pixels can be performed in higher reliability.

In the embodiment shown in FIG. 1, the display panel 100 is for example being implemented as being configured with a liquid crystal cell in which an aligned liquid crystal is filled in between two confronting sheets of glass substrates, and an electrode pattern is formed on each of the two sheets of glass substrate. Image display is performed through movement of the liquid crystal molecules caused by applying a voltage on the liquid crystal layer between the electrodes. Such a display panel 100 can also be referred to as an active matrix liquid crystal display (AMLCD).

Figure 5:
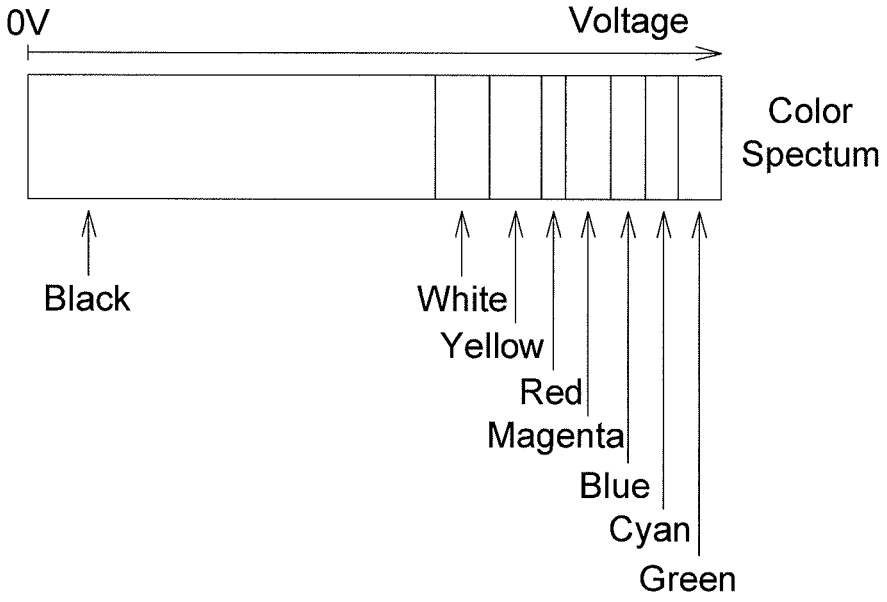
FIG. 5 is schematic diagram showing an example of the relationship between color spectrums and applied voltages of a pixel.

In another embodiment, the display panel is implemented as a birefringence-type color (BRC) liquid crystal display panel where expressed colors of a pixel element are controlled by the applied voltage across the pixel element. More specifically, in this BRC liquid crystal display panel, the coloring state of a pixel itself is changed by utilizing a phenomenon in which the color can be continuously changed in accordance with applied voltages due to the birefringence effect of a liquid crystal cell. In other words, a single pixel of the BRC liquid crystal display device can express various colors when being applied there across different voltages. An example is made with reference to FIG. 5. FIG. 5 is schematic diagram showing an example of the relationship between color spectrums and applied voltages of a pixel. In this example, in response to a 3-bit image data, 8 colors can be sequentially generated when the voltage applied to the pixel is increased for example from 0.5V to 4.78V.

Figures 6A, 6B:
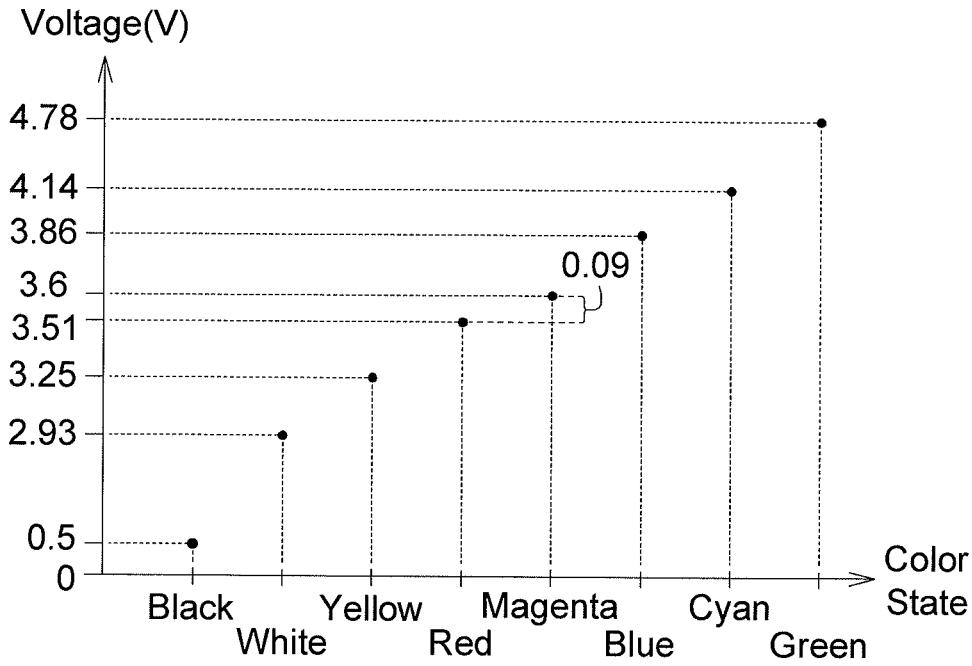
FIG. 6A is a table showing an example of the relationship between colors and applied voltages of a pixel where the applied voltages have a same polarity.
FIG. 6B is a coordinate diagram of the table in FIG. 6A.
Figures 7A, 7B:
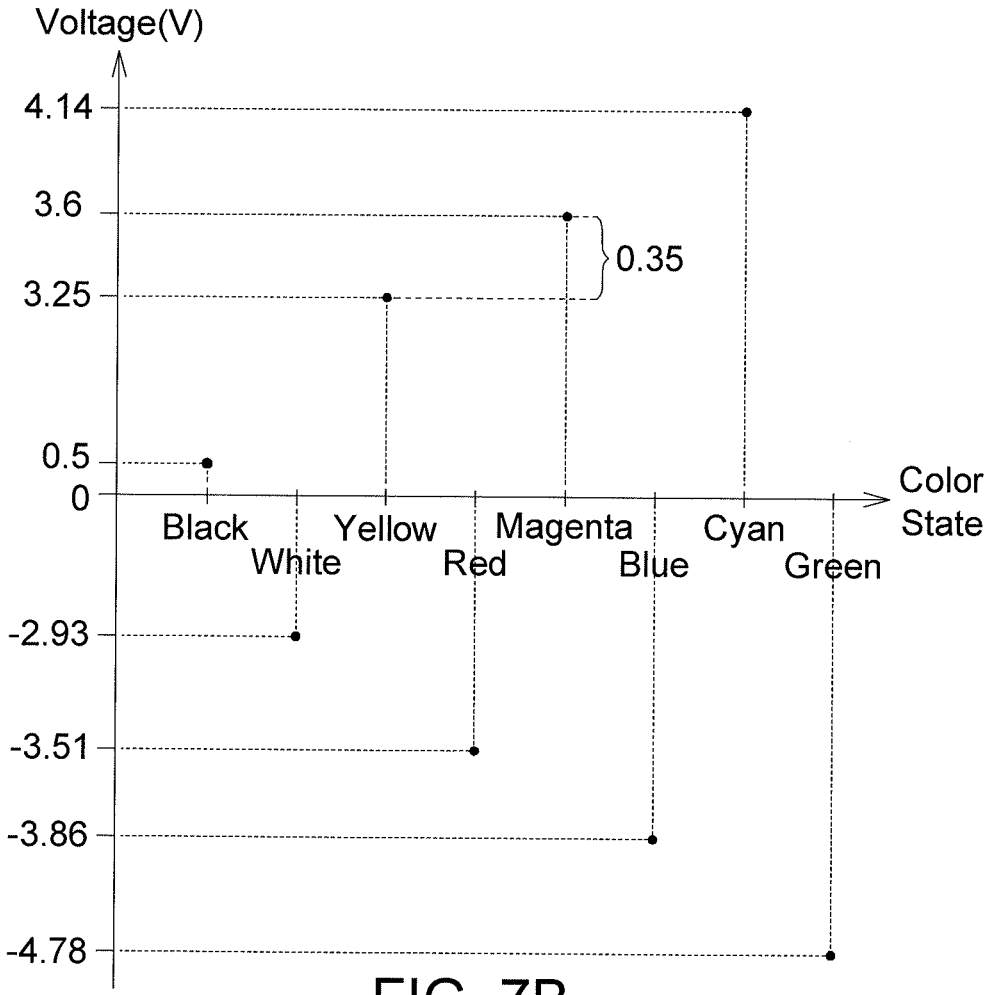
FIG. 7A is a table showing an example of the relationship between colors and applied voltages of a pixel according to an embodiment of the invention.
FIG. 7B is a coordinate diagram of the table in FIG. 7A.

FIG. 6A is a table showing an example of the relationship between colors and applied voltages of a pixel where the applied voltages have a same polarity. FIG. 6B is a coordinate diagram of the table in FIG. 6A. FIG. 7A is a table showing an example of the relationship between colors and applied voltages of a pixel according to an embodiment of the invention.

FIG. 7B is a coordinate diagram of the table in FIG. 7A. In FIGS. 6A and 6B, voltages used to generate these colors are assigned to have a single polarity, and the minimum voltage difference corresponding to two adjacent colors is 0.09V. In comparison, according to an embodiment related to FIGS. 7A and 7B, the voltages corresponding to two adjacent colors are assigned to have opposite polarities. In this way, the minimum voltage difference corresponding to two adjacent colors can be improved to about 0.35V.

Figure 8B:
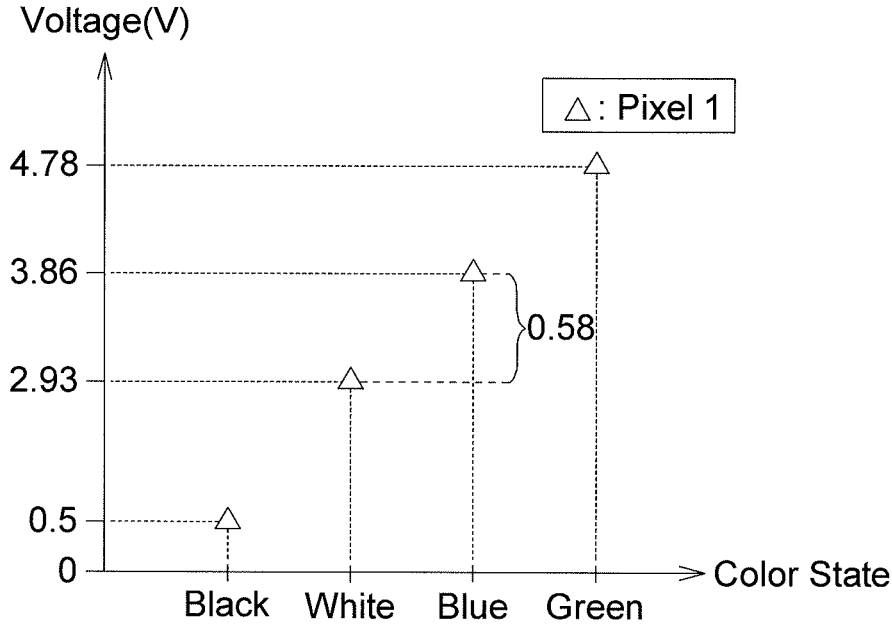
FIG. 8B is a coordinate diagram of the table in FIG. 8A.
Figure 8B:
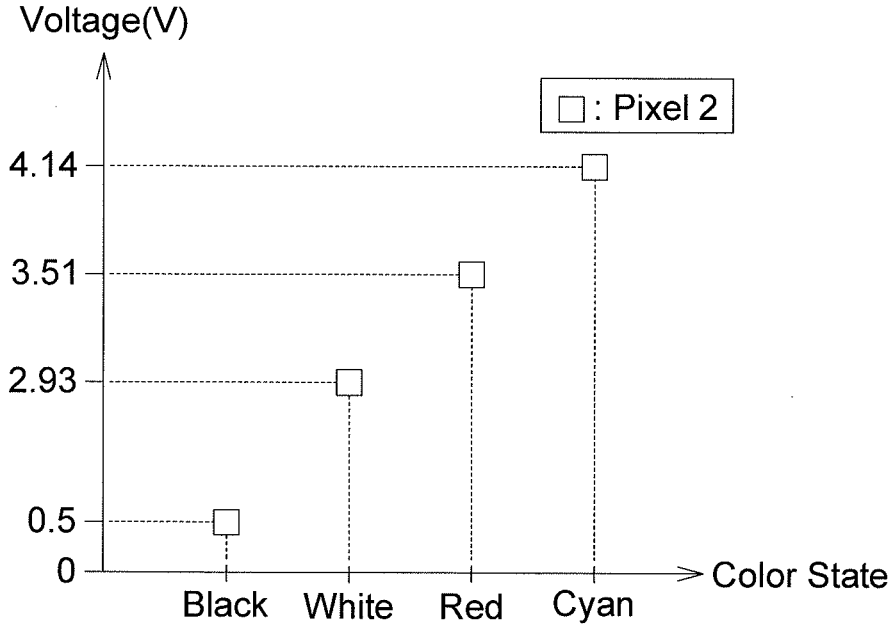
Figure 9B:
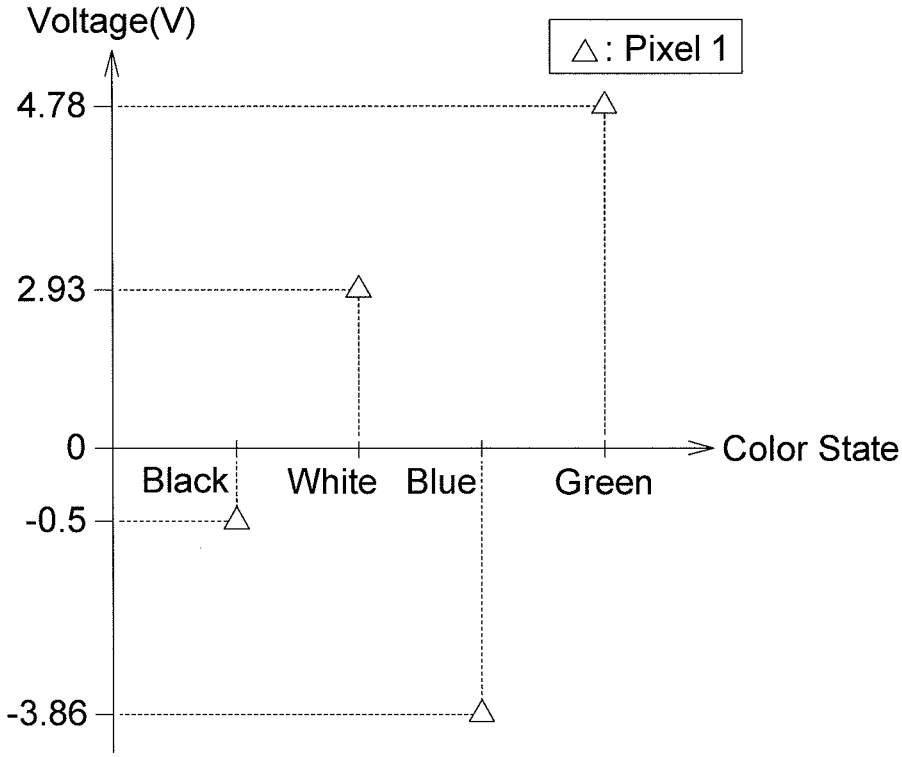
FIG. 9B is a coordinate diagram of the table in FIG. 9A.
Figure 9B:
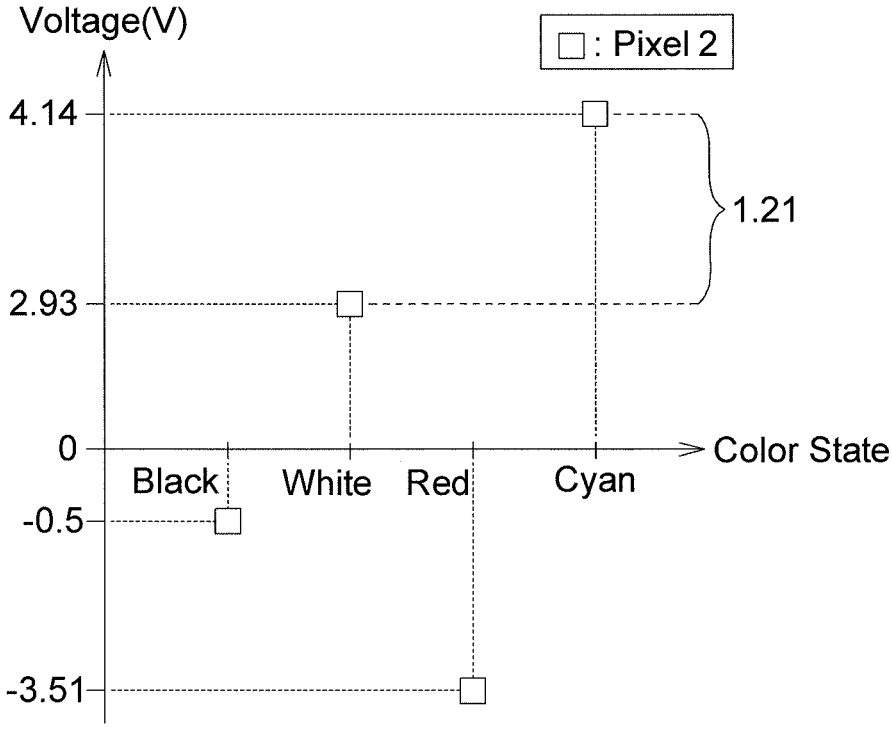

FIG. 8A is a table showing an example of the relationship between colors and applied voltages of two pixels where the applied voltages have a same polarity. FIG. 8B is a coordinate diagram of the table in FIG. 8A. FIG. 9A is a table showing an example of the relationship between colors and applied voltages of two pixels according to an embodiment of the invention. FIG. 9B is a coordinate diagram of the table in FIG. 9A. In the examples, two pixels are regarded as a new pixel to describe colors. In FIGS. 8A and 8B, voltages used to generate these colors are assigned to have a single polarity, and the minimum voltage difference corresponding to two adjacent colors is 0.58V. In comparison, according to an embodiment related to FIGS. 9A and 9B, the voltages corresponding to two adjacent colors are assigned to have opposite polarities. In this way, the minimum voltage difference corresponding to two adjacent colors can be improved to about 1.21V.

Figure 10:
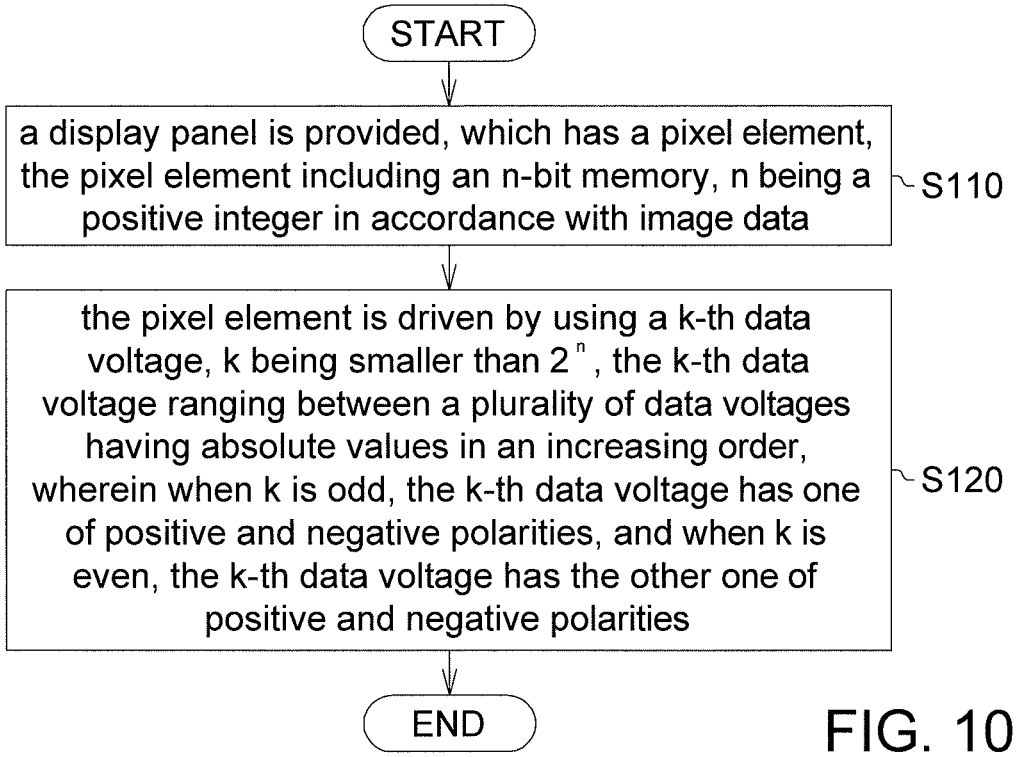
FIG. 10 is a flow chart showing an operation method for use in image data storing according to an embedment of the invention.

FIG. 10 is a flow chart showing an operation method for use in image data storing according to an embedment of the invention. The operating method in FIG. 10 can be for example used in the display panel 100 in FIG. 1. In step S110, a display panel is provided, which has a pixel element, the pixel element including an n-bit memory, n being a positive integer in accordance with image data. In step S120, the pixel element is driven by using a k-th data voltage, k being equal to or smaller $2^n$, the k-th data voltage ranging between a plurality of data voltages having absolute values in an increasing order. In this operating method, the data voltages of the data signal SOURCE are for example the grayscale voltages in FIGS. 4A or 4B used to generate different gray levels, or the voltages in FIG. 5 used to generate different colors, dependent on the type of the display panel 100. When k is odd, the k-th data voltage has one of positive and negative polarities, and when k is even, the k-th data voltage has the other one of positive and negative polarities. In this way, the minimum voltage difference corresponding to two adjacent gray levels or colors can be improved.

Refer to FIG. 1. As to the refresh unit 200, it can be implemented by a circuit with dynamic random access memory (DRAM), or a circuit with static random access memory (SRAM). An example of the refresh unit 200 is made with reference to an exemplary pixel element in FIG. 11, which is circuit based on DRAM.

Figure 11:
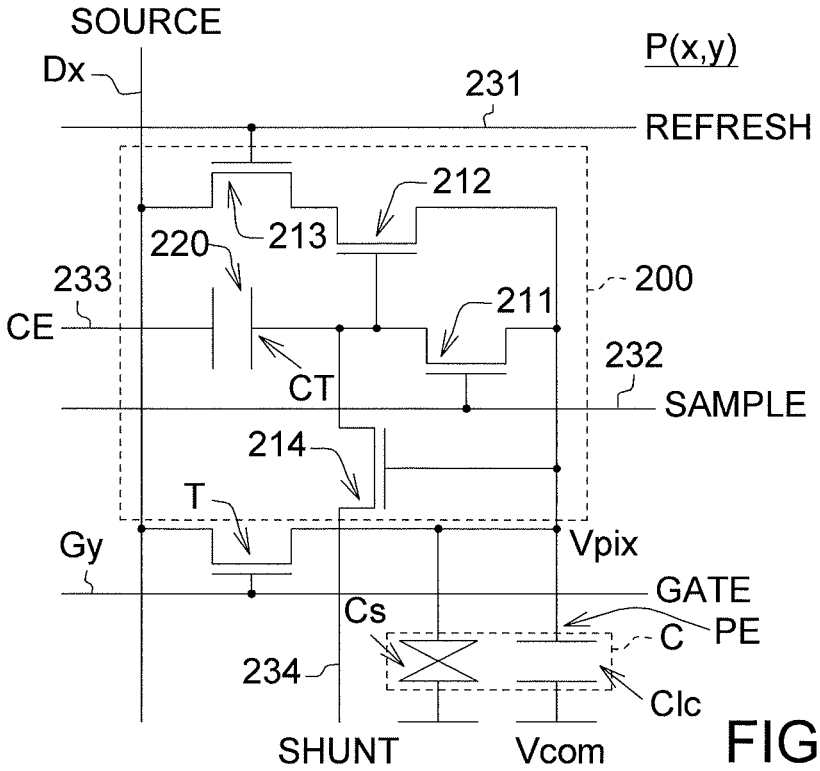
FIG. 11 is a block diagram showing a pixel element of the AMLCD device in FIG. 1 according to an embodiment of the invention.

FIG. 11 is a block diagram showing a pixel element of the AMLCD device 100 in FIG. 1 according to an embodiment of the invention. In this example of the pixel element P(x,y), the refresh unit 200 includes a first switch 211, a second switch 212, a third switch 213, a fourth switch 214, and a capacitive element 220. The first switch 211 has a control terminal for receiving a sample control signal SAMPLE. The second switch 212 has a control terminal coupled to a first terminal (denoted as a node CT) of the capacitive element 220. The third switch 213 has a control terminal for receiving a refresh control signal REFRESH. The third switch 213 and the second switch 212 are serially coupled with each other. The second switch 212 has a terminal coupled to a pixel electrode (denoted as a node PE) of the image data storage capacitor C, and the third switch 213 has a terminal for receiving a data signal SOURCE. The capacitive element 220 has the first terminal CT coupled to the pixel electrode PE of the image data storage capacitor C via the first switch 211. The capacitive element 220 further has a second terminal for receiving an enable signal CE. The fourth switch 214 has a control terminal coupled to the pixel electrode PE, a terminal coupled to the first terminal CT of the capacitive element 220, and another terminal for receiving a shunt control signal SHUNT.

Figure 12:
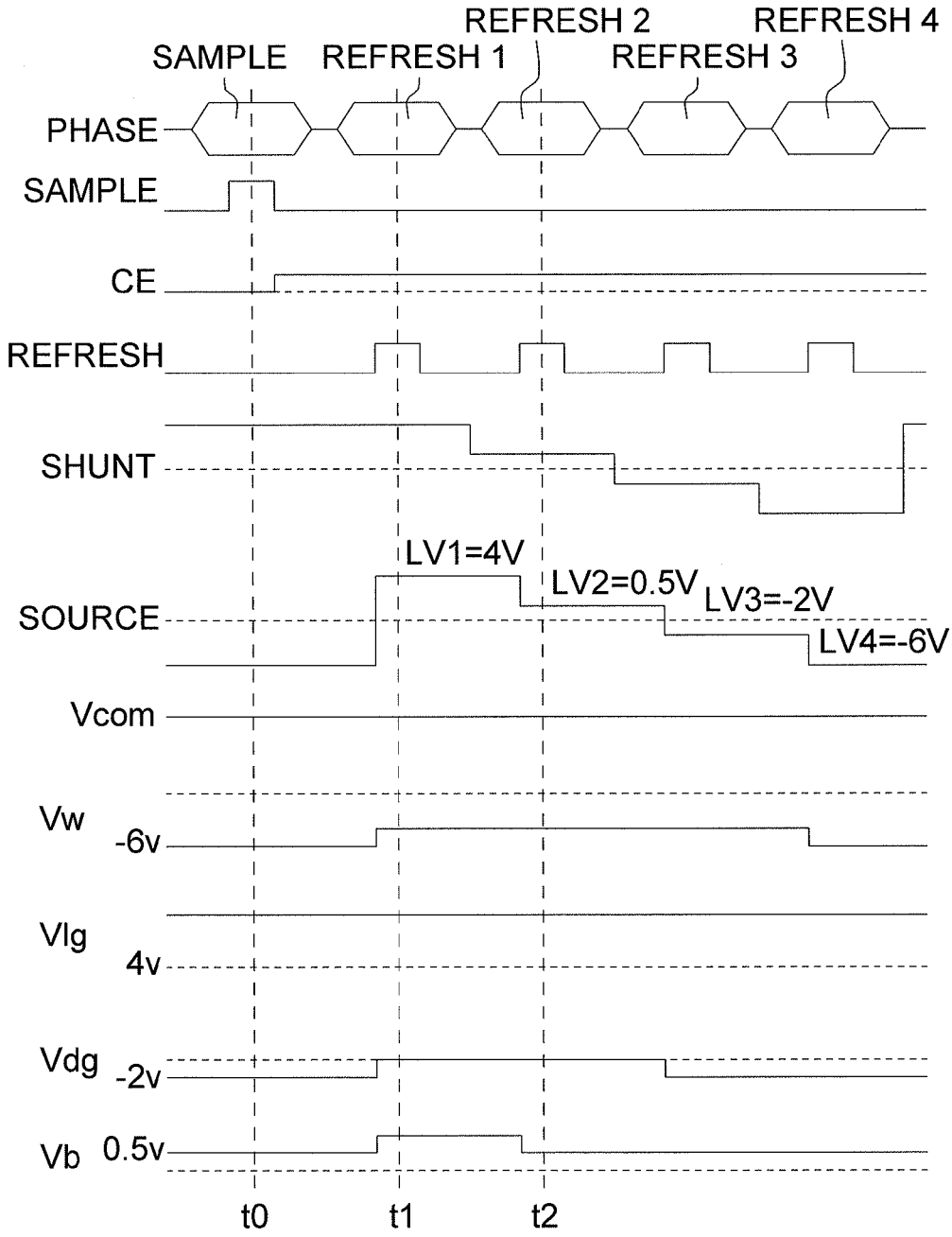
FIG. 12 is a timing diagram showing a number of signal waveforms that the display panel in FIG. 1 uses to execute an operating method according to an embodiment of the invention.

The operation of the pixel element in FIG. 11, thus, is exemplarily provided with reference to FIG. 12 as follows. FIG. 12 is a timing diagram showing a number of signal waveforms that the display panel in FIG. 1 uses to execute an operating method according to an embodiment of the invention.

As is shown in FIG. 12, the display panel 100 is operated to perform a sample operation, and four refresh operations, which is an example for refreshing a 2-bit MIP. Based on the relationship between gray levels and grayscale voltages of the 2-bit MIP shown in FIG. 3, the data signal SOURCE sequentially has four data voltages during four periods, such as a data voltage LV1 (LV1=+4V) during a first refresh operation, a data voltage of LV2 (LV2=+0.5V) during a second refresh operation, a data voltage LV3 (LV3=−2V) during a third refresh operation, and a data voltage LV4 (LV4=−6V) during a fourth refresh operation. These data voltages LV1 to LV4 are arranged in a monotonic order. The shunt control signal SHUNT has a number of voltages similarly to the data voltages LV1-LV4 of the data signal SOURCE. As such, the image data of "10", "00", "01", and "11" which corresponds to grayscale voltages Vlg, Vb, Vdg, and Vw of +4V, +0.5V, −2V, and −6V are sequentially refreshed. The refresh operation of the image data of "10" is exemplarily detailed as follows with reference to FIGS. 11 and 12.

In an embodiment, the image data of "10" (Vlg=Vpix−Vcom=4V) can be refreshed while its polarity selectively remained or inversed. In the example of FIG. 12, it is exemplified that the image data of "10" is refreshed while its polarity remained, e.g., "Vpix, Vcom"="4V, 0V" to "4V, 0V".

First, it is assumed that the pixel voltage Vpix is initially 4V and the common voltage Vcom is initially 0V, indicating that the image data stored in the image data storage capacitor C is "10", i.e., the voltage across the image data storage capacitor C is 4V. First, refer to a time t0 where a sample operation is performed. The sample control signal SAMPLE is enabled at a high level to turn on the first switch 211. Via the turn-on first switch 211, the first terminal CT of capacitive element 220 is biased at substantially the same level of the current pixel voltage Vpix. This means that the pixel voltage Vpix is sampled as a sample voltage Vsample and stored in the capacitive element 220, i.e., Vsample=4V. The enable signal CE is disabled at a first level of, for example, 0V.

Then, refer to a time t1 where a first refresh operation is performed. The data signal SOURCE has a first data voltage LV1 of, for example, 4V at time t1. The enable signal CE is transited from the first level to a second level of, for example, from 0V to 1.5V. The different between the first level and the second level of the enabled signal CE is, in this example, 1.5V, higher than the threshold voltage of the second switch 212, so as to compensate for the threshold voltage of the second switch 212. The enable signal CE pushes up the sample voltage Vsample to about 5.5V (=4V+1.5V) via the capacitive element 220. Between the sample voltage Vsample and the pixel voltage Vpix, there is a voltage difference of 1.5 V (Vsample−Vpix=5.5V−4V) higher than the threshold voltage of 1V of the second switch 212, so that the second switch 212 is turned on. Also, the refresh control signal REFRESH is enabled to turn on the third switch 213. Via the turn-on second and third switches 212 and 213, the first data voltage LV1 (=4V) of the data signal SOURCE is provided to refresh the pixel voltage Vpix of 4V which may have decayed due to TFT leakage current. Meanwhile, the common voltage Vcom is remained at a low level of, for example, 0V. Thus, when the first refresh operation is performed, the refreshed image data at time t1 ("Vpix, Vcom"="4V, 0V") has the same polarity as the polarity of the image data at time t0 ("Vpix, Vcom"="4V, 0V").

Next, refer to a time t2 where a second refresh operation is performed. The data signal SOURCE has a second voltage LV2 of, for example, 0.5V at time t2. Similarly, the shunt control signal SHUNT has the second voltage of 0.5V. The second voltage LV2 is used to refresh another image data of 0.5V stored in another image data storage capacitor. Between the pixel voltage Vpix and the second voltage LV2 of the shunt control signal SHUNT, there is a voltage difference of 3.5V (Vpix−LV2=4V−0.5V) higher than the threshold voltage of 1V of the fourth switch 214, so that the fourth switch 214 is turned on. Via the turn-on fourth switch 214, the first terminal CT of the capacitive element 220 is biased at the second voltage LV2 of the shunt control signal SHUNT, i.e., Vsample=0.5V. At this time, the second switch 212 is turned off since the voltage difference therebetween is −3.5V (Vsample−Vpix=0.5V−4V), lower than its threshold voltage of 1V. In this way, the second data voltage LV2 (=0.5V) of the data signal SOURCE will not be used to refresh the pixel voltage Vpix of 4V, neither will the third data voltage LV3 (=−2V) and the fourth data voltage LV4 (=−6V) of the data signal SOURCE.

As to the image data of "11", "01", and "00" (Vlg=Vpix−Vcom=−6V, +0.5V, and −2V), their operation, thus, can be described similarly with reference to the above-related description of the image data of "10", and will not be specified for the sake of brevity.

According to the operating method and the display panel disclosed in the embodiment of the invention, opposite voltage polarities are used such that the voltage difference corresponding to two adjacent gray levels or colors is increased. In this way, the refresh operation of pixels can be performed in higher reliability. Therefore, the number of bits per pixel can be increased.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An operating method for use in image data refreshing, the method comprising:

in a first period, providing a data signal having a first data voltage to selectively refresh an image data of an image data storage capacitor of a pixel element by a refresh unit; and in a second period, providing the data signal having a second data voltage to selectively refresh the image data of the image data storage capacitor by the refresh unit, the polarity of the second data voltage being opposite to the polarity of the first data voltage, wherein the refresh unit comprises:

a first switch having a control terminal for receiving a sample control signal;

a capacitive element having a first terminal coupled to a pixel electrode of the image data storage capacitor via the first switch;

a second switch having a control terminal coupled to the first terminal of the capacitive element;

a third switch having a control terminal for receiving a refresh control signal, the third switch and the second switch being serially coupled with each other, the second switch and third switch being coupled between the corresponding source line and the image data storage capacitor for receiving the data signal; and a fourth switch having a control terminal coupled to the pixel electrode, a data terminal coupled to the first terminal, and another data terminal for receiving a shunt control signal; wherein the fourth switch controlling the turn-off or the turn-on of the second switch according to the image data, when the image data is of a first image data, the second switch is turned on during the first period and turned off during the second period, to refresh the image data of the image data storage capacitor during the first period, and when the image data is of a second image data which is numerically adjacent with the first image data, the second switch is turned off during the first period and turned on during the second period, to refresh the image data of the image data storage capacitor during the second period.

2. The method according to claim 1, wherein the k-th data voltage is a grayscale voltage corresponding to a k-th gray level of the pixel element.

3. The method according to claim 1, wherein the method is for use in a birefringence color (BRC) liquid crystal display panel where expressed colors of the pixel element are controlled by the applied voltage across the pixel, and the k-th data voltage is a voltage corresponding to an expressed color of the pixel element.

4. The method according to claim 1, wherein the k-th data voltage is shifted from the zero voltage to a predefined voltage such that the voltage difference between the k-th data voltage and the (k+1)-th data voltage is increased, and the optical property of the pixel element is substantially remained.

5. The method according to claim 4, wherein when k is zero, the predefined voltage is within a range of 1V and −1V.

6. The method according to claim 1, further comprising:

sampling the image data of the image data storage capacitor before the first period and the second period, wherein the refreshed image data in the image data storage capacitor has the same polarity as the polarity of the image data stored in the image data storage capacitor in the step of sampling.

7. The method according to claim 1, further comprising:

sampling the image data of the image data storage capacitor before the first period and the second period, wherein the refreshed image data in the image data storage capacitor has the inversed polarity as the polarity of the image data stored in the image data storage capacitor in the step of sampling.

8. A display panel, comprising:

an active matrix pixel array comprising:

a plurality of gate lines;

a plurality of source lines;

a gate driver for driving the gate lines;

a source driver for driving the source lines; and a plurality of pixel elements arranged in a matrix, each pixel element being coupled to a corresponding gate line of the plurality of gate lines and a corresponding source line of the plurality of source lines, each pixel element including an n-bit memory, n being in accordance with image data; and each pixel element comprises:

an image data storage capacitor for storing an image data; and a gate switch having a control terminal coupled to the corresponding gate line, and two data terminals coupled between the corresponding source line and the image data storage capacitor; and a refresh unit coupled between the corresponding source line and the image data storage capacitor, the refresh unit for refreshing the image data stored in the image data storage capacitor according to a data signal, wherein the refresh unit comprises:

a first switch having a control terminal for receiving a sample control signal;

a capacitive element having a first terminal coupled to a pixel electrode of the image data storage capacitor via the first switch;

a second switch having a control terminal coupled to the first terminal of the capacitive element;

a third switch having a control terminal for receiving a refresh control signal, the third switch and the second switch being serially coupled with each other, the second switch and third switch being coupled between the corresponding source line and the image data storage capacitor for receiving the data signal; and a fourth switch having a control terminal coupled to the pixel electrode, a data terminal coupled to the first terminal, and another data terminal for receiving a shunt control signal; wherein in a first period, the source driver for driving the pixel element by providing the data signal having a first data voltage to selectively refresh the image data of the image data storage capacitor of the pixel element;

in a second period, the source driver for driving the pixel element by providing the data signal having a second data voltage to selectively refresh the image data of the image data storage capacitor, the polarity of the second data voltage being opposite to the polarity of the first data voltage; and when the image data is of a first image data, the image data of the image data storage capacitor is refreshed during the first period, and when the image data is of a second image data which is numerically adjacent with the first image data, the image data of the image data storage capacitor is refreshed during the second period.

9. The display panel according to claim 8, wherein the refresh unit is further for sampling the image data of the image data storage capacitor before the first period and the second period, and the refreshed image data in the image data storage capacitor has the same polarity as the polarity of the image data stored in the image data storage capacitor during the sampling.

10. The display panel according to claim 8, wherein the refresh unit is further for sampling the image data of the image data storage capacitor before the first period and the second period, and the refreshed image data in the image data storage capacitor has the inversed polarity as the polarity of the image data stored in the image data storage capacitor during the sampling.

* * * * *